US008647004B2

(12) United States Patent
Chan

(10) Patent No.: US 8,647,004 B2
(45) Date of Patent: Feb. 11, 2014

(54) ASSEMBLING STRUCTURE OF INTERMEDIATE TUBE OF LIPSTICK

(76) Inventor: Li-Chun Chan, Taichung (TW)

( * ) Notice: Subject to any disclaimer, the term of this patent is extended or adjusted under 35 U.S.C. 154(b) by 0 days.

(21) Appl. No.: 13/466,092

(22) Filed: May 7, 2012

(65) Prior Publication Data

US 2013/0294810 A1 Nov. 7, 2013

(51) Int. Cl.
*B43K 21/08* (2006.01)

(52) U.S. Cl.
USPC ..... 401/78; 401/68; 401/75

(58) Field of Classification Search
USPC ..... 401/78, 68, 75, 77, 116
See application file for complete search history.

(56) References Cited

U.S. PATENT DOCUMENTS

| | | | | |
|---|---|---|---|---|
| 4,812,066 | A * | 3/1989 | Gueret | 401/78 |
| 5,348,410 | A * | 9/1994 | Shozi et al. | 401/78 |
| 5,876,137 | A * | 3/1999 | Byrd | 401/78 |
| 6,109,808 | A * | 8/2000 | Susini et al. | 401/78 |
| 6,217,243 | B1 * | 4/2001 | Monin-Bareil | 401/78 |
| 6,312,179 | B1 * | 11/2001 | Gueret | 401/78 |
| 6,412,999 | B1 * | 7/2002 | Pierpont | 401/68 |
| 6,827,213 | B2 * | 12/2004 | Hirotomi et al. | 401/78 |
| 7,112,002 | B2 * | 9/2006 | Susini et al. | 401/78 |
| 7,322,765 | B2 * | 1/2008 | Wang et al. | 401/78 |
| 7,325,991 | B2 * | 2/2008 | Holloway | 401/78 |
| 8,267,606 | B2 * | 9/2012 | Delbove et al. | 401/78 |
| 2006/0056902 | A1 * | 3/2006 | Susini et al. | 401/78 |
| 2006/0291948 | A1 * | 12/2006 | Holloway | 401/78 |
| 2007/0059088 | A1 * | 3/2007 | Chan | 401/68 |
| 2008/0016706 | A1 * | 1/2008 | Sasaki | 401/78 |
| 2009/0188513 | A1 * | 7/2009 | Delbove | 401/78 |

* cited by examiner

*Primary Examiner* — David J. Walczak
*Assistant Examiner* — Bradley Oliver
(74) *Attorney, Agent, or Firm* — Leong C. Lei

(57) ABSTRACT

The present invention provides an improved assembling structure of intermediate tube of lipstick, which is an improvement of assembling positioning structure of intermediate tube of lipstick that realizes comfortable and smooth rotation control in out-feeding lipstick, generally including a plurality of equally divided and slightly convexly raised elastic flange plates that are formed on a circumferential surface of a rotary base to which an intermediate tube is assembled, whereby the intermediate tube, when assembled, shows a point elastic pushing positioning assembling with respect to the rotary base so that when the rotary base is rotated to control the internally received lipstick holder to raise or lower, an effect of safe use that is realized by positive engagement and shaking-free rotation control. As such, the assembling structure of lipstick is made stable and positive and comfort and safety of the use of the lipstick are ensured.

4 Claims, 6 Drawing Sheets

ASSEMBLING STRUCTURE OF INTERMEDIATE TUBE OF LIPSTICK

TECHNICAL FIELD OF THE INVENTION

The present invention generally relates to an improved assembling structure of intermediate tube of lipstick, and more particularly to assembling between an intermediate tube and a rotary base of a lipstick structure in which a circumferential surface of the rotary base to which the intermediate tube is assembled forms multiple flange plates that are elastic and raised to ensure positive assembling and positioning in fitting and assembling the intermediate tube and to ensure the operation of extension and retraction of the lipstick is free of vibrating and in-positive rotation control so as to achieve the practical advantage and purpose of safe operation of lipstick.

DESCRIPTION OF THE PRIOR ART

As shown in FIGS. 5 and 6, a conventional structure of lipstick comprises a rotary base (30) that serves as a controller for rotation. A rotary inner tube (31) extending upward from the rotary base (30) has a circumferential surface in which slide channels (32) are formed. A lipstick (33) is received and retained in a lipstick holder (34), which is in turn received in the rotary inner tube (31). Arranged outside the assembled rotary inner tube (31) is a structure assembly of mutually-bonded combination of a metal intermediate tube (40) and a plastic spiral sleeve (41). The sleeve (41) that is provided with an arrangement of spiral guide slots (42) and received in the intermediate tube (40) allows two projecting pegs (35) formed on opposite sides of the lipstick holder (34) to fit into the guide slots (42) and also received in the slide channels (32) of the inner tube (31) to impose desired constraints and guidance to movement. Thus, through control effected by rotation of the rotary base (30), an operation of ascending and descending the lipstick holder (34) can be realized, so as to raise and lower the lipstick (33) for easy use of makeup. When rotation of the rotary base (30) is made in an opposite direction, the lipstick holder (34) may easily retract back to the bottom of the inner tube (31) for secured storage of the lipstick (33). This constitutes a complete structure of lipstick.

In the whole structure of lipstick, the inner tube (31) of the rotary base (30) and the intermediate tube (40) are arranged in a mutually-fitting relationship with a bottom end of the intermediate tube (40) exactly located at a top face (30) of a stepped structure of the rotary base (30) to form such an assembly as being positioned thereon. Due to the inner tube (40) and the spiral sleeve (41) being mutually fit to each other and bonded together in such a way that the plastic sleeve (41) is bonded internally, after the plastic sleeve (41) is fit to the metal intermediate tube (40), to achieve easy operation of rotation in the assembly of the plastic sleeve (41) and the rotary base (30), the plastic molding of the plastic sleeve is often made to leave tolerance, and this makes it not possible for the plastic sleeve to form a precise assembly with the rotary base (30) in respect of the assembling sizes thereof, so that a gap exists. Such a gap-based assembling often leads to loose and vibrating tolerance of assembly between the rotary base (30) and the intermediate tube (40) when the intermediate tube (40) is held and rotated. This leads to vibrating and shifting in an actual operation of rotation for raising and lowering the lipstick and this also affects the lipstick (33) being properly guided in the sliding movement thereof for extension and retraction. Further, assembling tolerance also exists between the guide slots (42) and the slide channels (32) and this, when included in the operation of rotation, further makes the operation of rotation more severely vibrating. This is no just of poor quality for use of the lipstick and also affects the value of the lipstick product. Thus, it is desired to provide a further improvement of the structure and assembly of the intermediate tube of the existing lipsticks in order to allow the rotation and control structure of the lipstick to achieve stable and smooth operation of rotation and thus the assembling of lipstick can actually meet the needs of being practical and safe.

SUMMARY OF THE INVENTION

The inventor has been working in molding of utensils of makeup products and has tens of years' experience and is fully aware of the various utility problems that are caused, in the operation of rotation control of lipstick, by assembling clearance between an intermediate tube and a rotary base so that after devoted research and study, with times of development and improvement, an improved assembling structure of intermediate structure of lipstick, as will be further described hereinafter, is accomplished, in which at the site of connection between a combination of intermediate tube and plastid sleeve of the lipstick that is fully fit to a bottom of an inner tube and a top circumferential surface of the rotary, the circumferential surface of the base is made hollow to form a plurality of elastic flange plates that are slightly raised such that when the intermediate tube, after being fit, is elastically pushed and positioned from the bottom thereof by the elastic flange plates thereby effectively overcoming the clearance generated in an actual assembling process to make the rotation control of the lipstick free of operation defeats of loosening and vibrating.

An object of the present invention is that flange plates that has bottoms forming hollow slots, are slightly raised, and can effect elastic pushing are formed in an overlapping circumferential surface between the rotary base and the intermediate tube, so that the intermediate tube is subjected to pushing to show tight engagement of assembling and with multiple-point elastic contact, when the rotary base is rotated for controlling, the rotation is effort less and is more positive to ensure no existence of clearance in the assembling between the intermediate tube and the inner tube to thereby realize stable and positive rotation control that is free of loosening and vibrating and the extension and retraction of lipstick for use is made smooth, safe, and positive.

Another object of the present invention is that the top circumferential surface of the rotary base forms multiple equally-divided slightly-raised elastic flange plates that are circumferentially distributed and an arrangement of multiple point contact support is made in a circumferential surface with the flange plates, so that the rotation control of the rotary base is made smooth and effort less and minute assembling clearance are eliminated to allow the assembling operation of the lipstick to be done easily and conveniently to truly achieve the practical purposes of effort-less and safe operation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
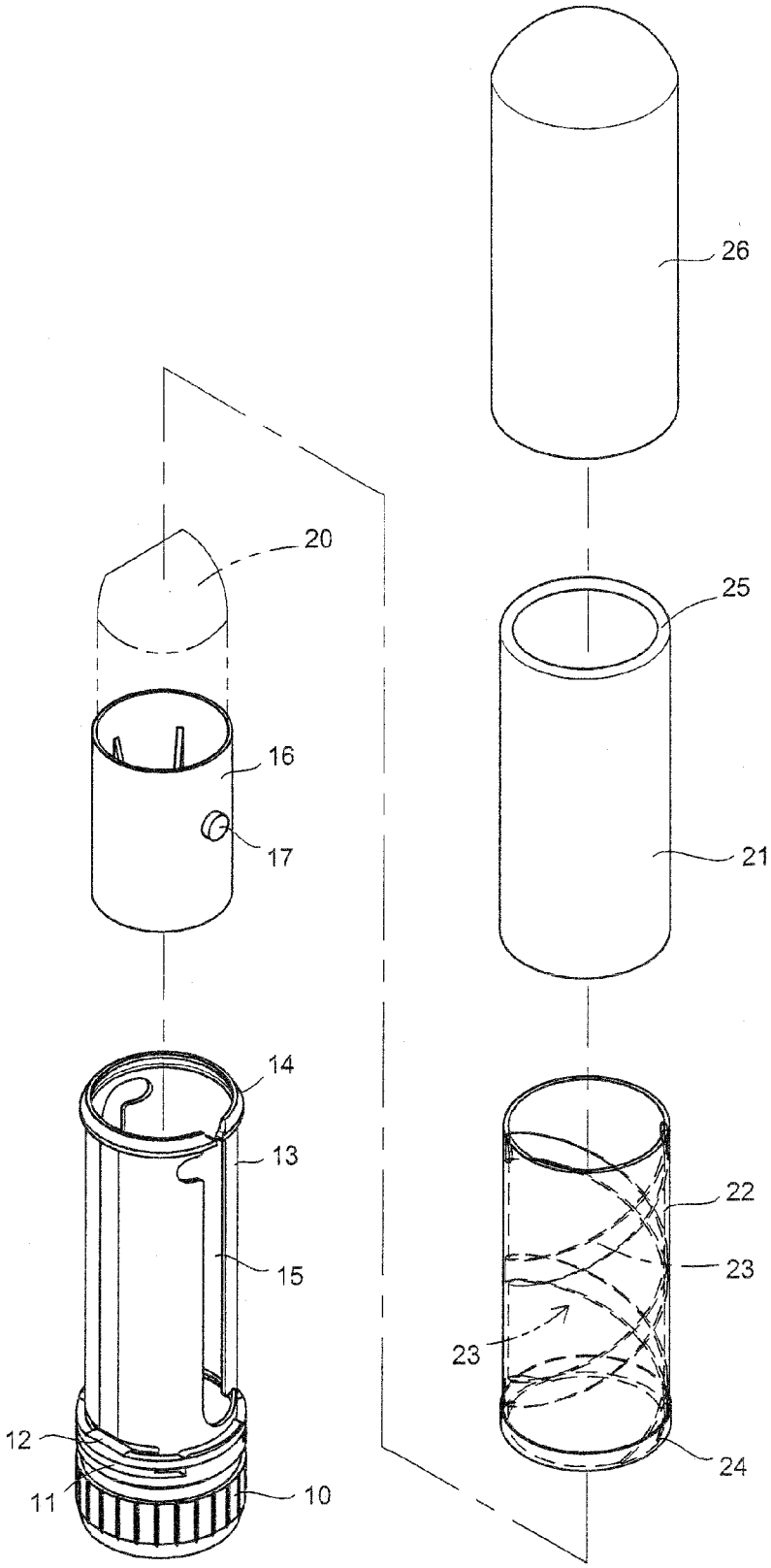
FIG. 1 is an exploded view of the assembly of lipstick structure according to the present invention.
Figure 2:
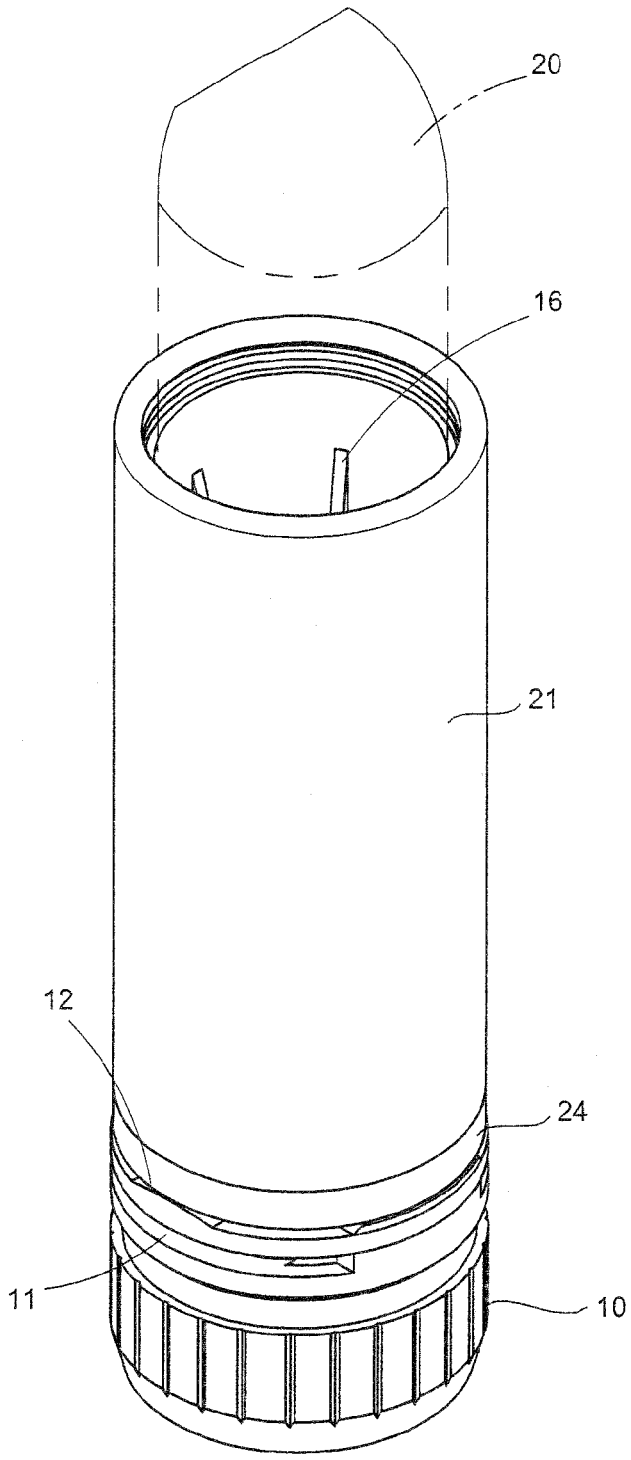
FIG. 2 is a perspective view of the assembly of intermediate tube structure of the lipstick according to the present invention.
Figure 3:
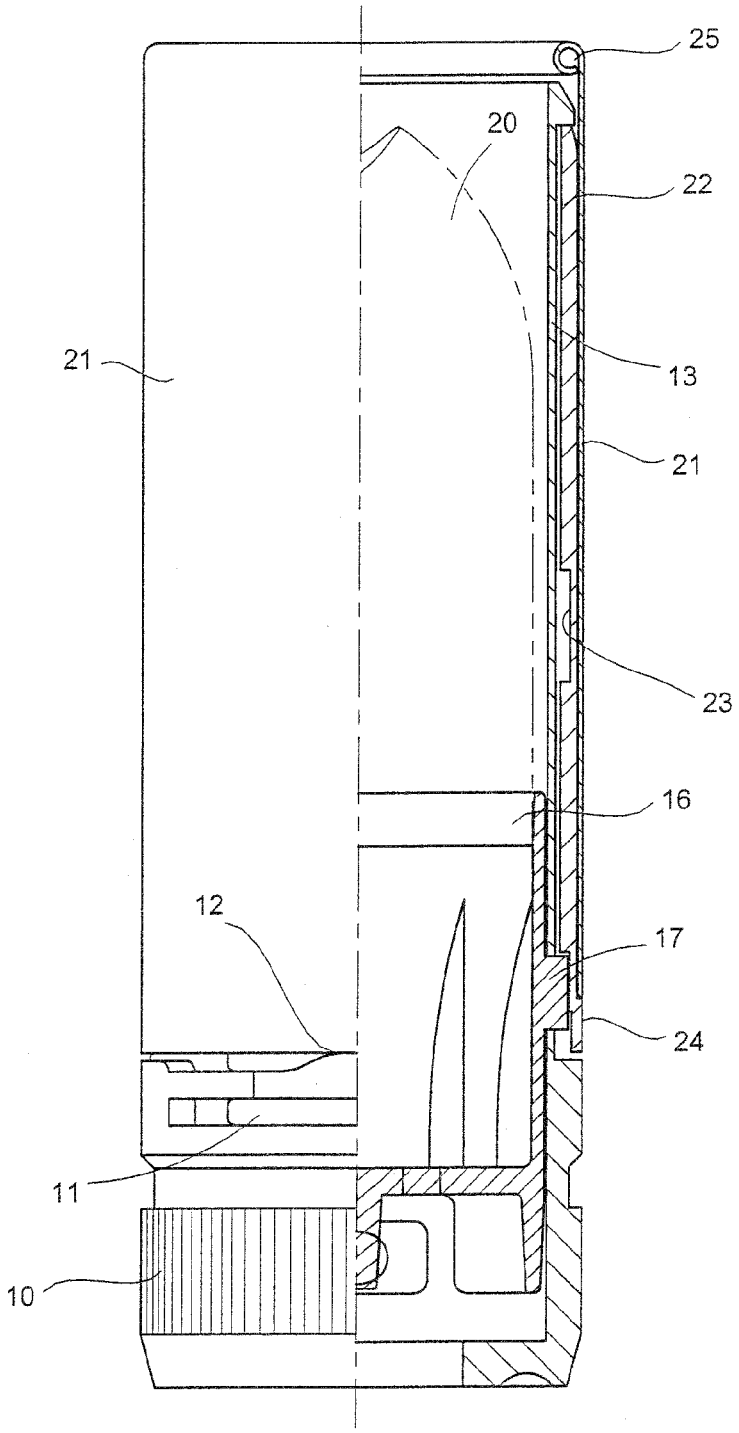
FIG. 3 is a plan view of the assembly of lipstick structure of the present invention.
Figure 4:
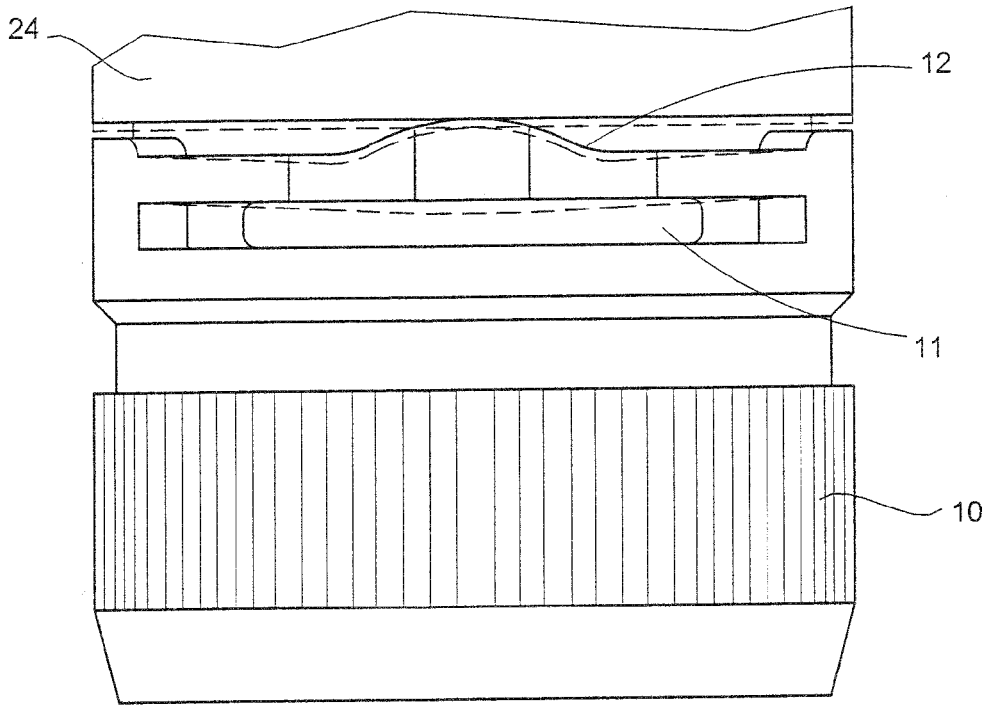
FIG. 4 is an enlarged view showing the assembly of intermediate tube and rotary base of the lipstick according to the present invention.
Figure 5:
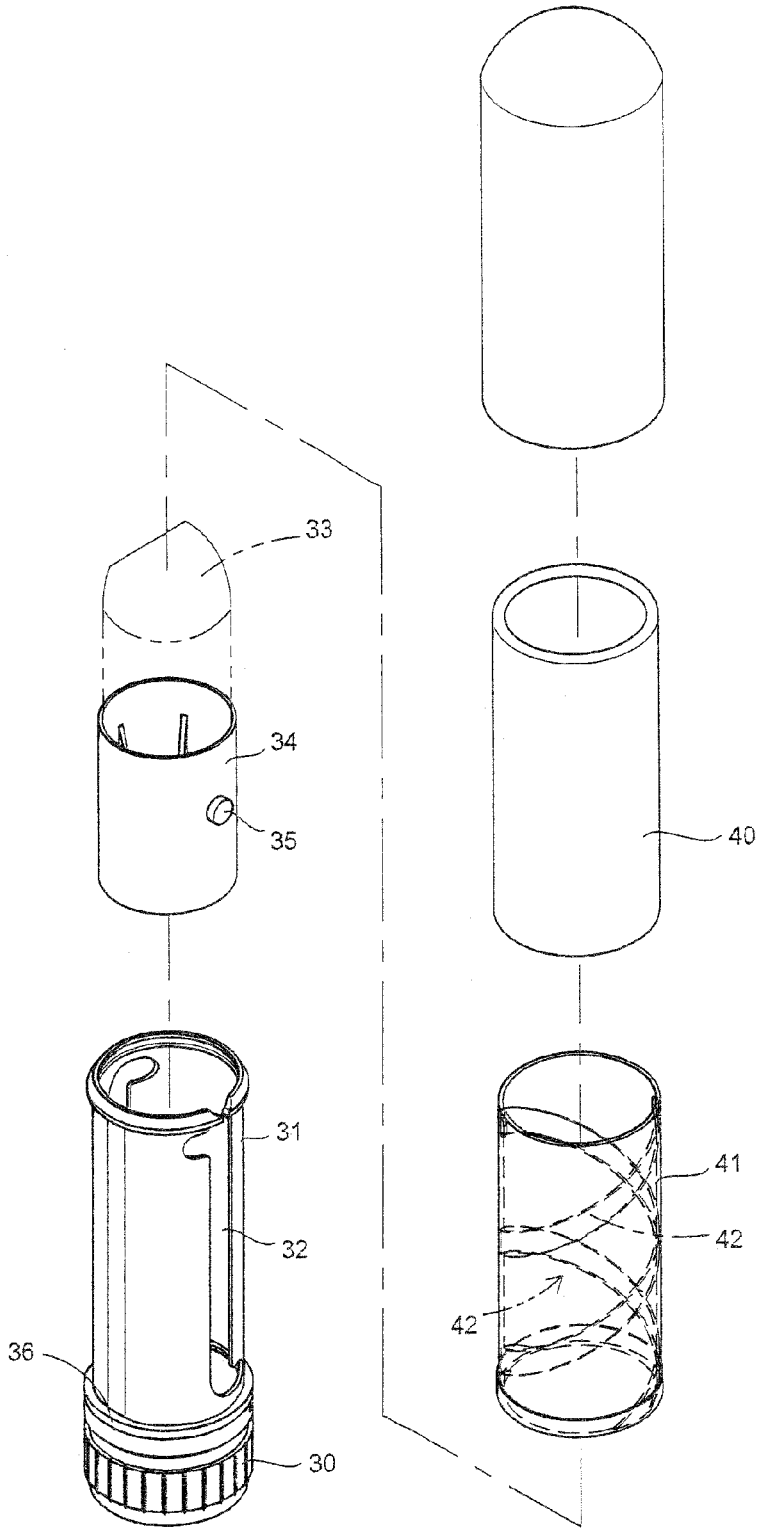
FIG.5 PRIOR ART
FIG. 5 is an exploded view showing an assembly of structure of a conventional lipstick.
Figure 6:
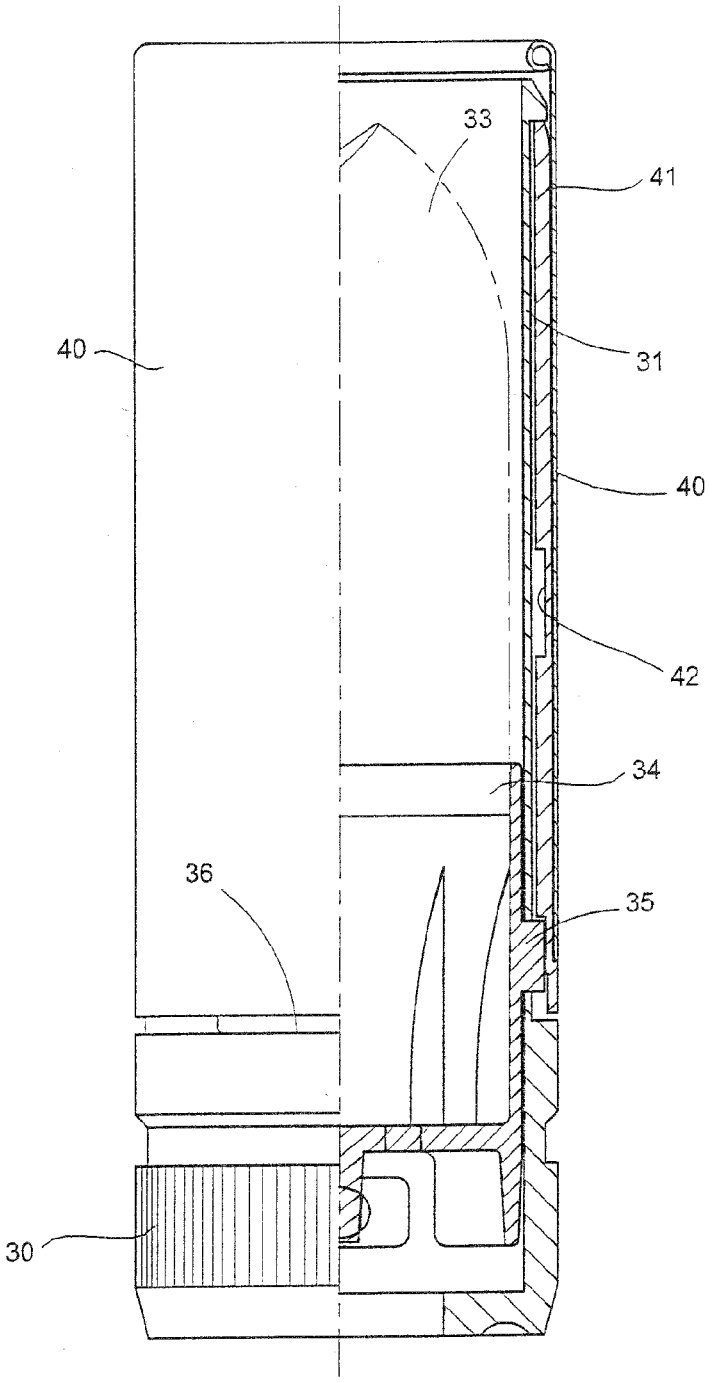
FIG.6 PRIOR ART
FIG. 6 is plan view of the assembly of structure of the conventional lipstick.

The present invention provides an improved assembling structure of intermediate tube of lipstick, in which the assembling structure of the whole set of intermediate tube of lipstick is, generally, similar to the conventional known intermediate tube assembling structure of regular lipstick. The entire improvement is illustrated in FIGS. 1-4 and comprises a rotary base (10) that has a bottom forming an expanded circumferential seat structure for easy holding and rotating for control and use. The base has a top forms a plurality of flange plates (12) that is arranged symmetric in radial direction and is equally and circumferentially divided and have bottoms forming hollow slots (11). The spacing of the bottom hollowness allows the flange plates (12) that are raised slightly to effect an elastic abutting effect. An inner tube (13) extends from a top center of the rotary base (10) within an inner circumference surrounded by the surrounding and circumferentially-distributed flange plates (12), in which the tube has a top end forming a sloped end (14) that projects outward to serve as a stiff aid to the top rim of the inner tube. The whole tube surface of the inner tube (13) is provided, in advance, opposite vertical slide channels (15) so that a holder (16) that is provided for receiving and retaining a lipstick (20) is received in the interior of the inner tube (13). The holder (16) has an outer circumferential surface that forms, at opposite sides, positioning pegs (17) that project outward for directly fitting into and slighting extending beyond the slide channels (15). Arranged outside the inner tube (13) that receives the holder (16) assembled therein, a complete structure of intermediate tube (21) that is formed by combining a metal intermediate tube (21) and a plastic spiral sleeve (22) by first coating adhesive agent to either n an inner side of the intermediate tube (21) or an outer circumferential surface of the sleeve (22) in order to realize mutual bonding with respect to the sleeve (22) for forming an integrated structure. The entire sleeve (22) forms, in an inner circumferential surface thereof, recessed spiral guide slots (23) and also forms, at a bottom thereof, a step-like end ring (24) having an outside diameter substantially corresponding to outside diameters of the rotary base (10) and the intermediate tube (21), whereby, after being fit to and assembled with the intermediate tube (21) and the rotary base (10), the outer circumference is made substantially flush and the bottom of the intermediate tube (21) is allowed to position on a top end of the end ring (24) in a registered manner. Further, top end of the sleeve (22), after the entire intermediate tube (21) is fit into and assembled with the intermediate tube (13), is exactly positioned on an undersurface of the sloped end (14) at the top of the intermediate tube (13) to provide an engaging and positioning effect, whereby after being assembled, the inner tube (13) has the top end thereof slightly retracted back below a constraint tube end (25) of the intermediate tube (21) to be housed thereby and the projecting pegs (17) of the lipstick holder (16) have projecting sections thereof directly fit into the spiral guide slots (23). Thus, to use the lipstick, on hand may hold and rotate the rotary base (10), while another hand holds and fixes the outer circumference of the intermediate tube (21) with the internally arranged spiral sleeve (22) being held simultaneously, whereby the internal lipstick holder (16) moves along the spiral guide slots (23) formed in the inside surface of the sleeve (22) to constantly raise and project the lipstick for makeup. The assembled structure of the intermediate tube (21) allows the bottom of the bottom end ring (24) of the internal sleeve (22) to exactly position on the elastic flange plates (12) to allow the structure of the intermediate tube (21) to which the plastic spiral sleeve (22) is assembled to stably and surely couple to other components, such as the inner tube (13) without causing any vibration and shaking, and ensuring the lipstick holder (16) that is received in the inner tube (13) is provided with positive assistance for pushing and positioning within the slide channels (15) and the guide slots (23) and further ensuring an effect of stable and positive control of operation of sliding movement during the operations of rotation control and raising and lowering so as to provide safety of use of the lipstick (20) for makeup. Externally, an outer cover (26) is provided for coverage for storage so as to collectively form an assembling structure of lipstick that is completely housed and of operation safety.

The improved feature of the structure improvement of the lipstick intermediate tube (21) according to the present invention is that a plurality of elastic flange plates (12) that is provided, in advance and for assembling, in an equally-divided manner with bottoms forming hollow slots (11) on the base body top circumferential surface of the rotary base (10) for to allow the intermediate tube (21), after being assembled with the plastic spiral sleeve (22) in an integrated manner, to directly fit to and thus cover the inner tube (13) with the bottom thereof directly engaging the top of the rotary base (10) in such a manner that a point pushing contact is formed with convex curved faces of the slightly raised flange plates (12), whereby the coupling of the internal assembling structure of the intermediate tube (21) of the entire lipstick is made relatively stable and positive by the elastic pushing assembling realized by the flange plates (12) and the point-surface contact based assembling mode minimizes the contact surface area so that the control and rotation operation of the lipstick can show an effort-saving but loosening-free condition for it is consistently and elastically pushed and positioned. Thus, the condition that the rotation and control of the rotary base (10) is effort saving but showing only minor interference. The arrangement for elastic upward pushing and assisting positioning allows no clearance of fitting and assembling occurring when the internally received lipstick holder (16) undergoes operations of raising and lowering and extension and retraction with the pegs (17) of the holder (16) being received in the slide channels (15) and the guide slots (23). Thus, rotation control and movement can be made more positive. Such an improved feature of structure is clearly beyond various rotation control structures of all the lipsticks that are currently available and may help effectively improving the situations of loosening and shaking of rotation control caused by accumulation of assembling clearances generated by insufficient dimension preciseness found in the molding process for manufacture among the assembled components that are plastic molded, so that the quality of the lipstick is improved and values of the product are increased for being practical and safe. The improvement made in practical utility for assembling stability and positiveness is apparently a significant improvement of utility for assembling structure of lipstick intermediate tube.

In summary, the present invention provides an improved assembling structure of intermediate tube of lipstick, which directly forms flange plate with elasticity on a top surface of the rotary base in a circumferentially distributed manner in order to provide an assistance of elastic pushing and positioning for the assembling thereof with respect to the intermediate tube to ensure stable and positive assembling for rotation control of the lipstick, making the assembling and positioning techniques of the intermediate tube of lipstick remarkably simplified and quality and practical utility of the lipstick greatly improved. Such a simplified and practically safe improvement of structure for assembling is a novel idea for the assembling structure of the intermediate tube of the lipstick.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved assembling structure of intermediate tube of lipstick, comprising a rotary base for assembling of lipstick and comprising an extending inner tube that is mounted to the rotary base, forms slide channels, and receives therein a holder for receiving and holding a lipstick and an intermediate tube structure that is fit outside the inner tube and comprises a metal intermediate tube and a plastic sleeve comprising internal spiral guide slots that are mutually fit to each other to integrate with each other, which are collectively assembled together to form a complete lipstick structure, characterized in that the plastic sleeve has a bottom ring that is expanded to form a circumferential step having an outside diameter substantially corresponding to outside diameters of the rotary base and the metal intermediate tube to allow a bottom end of the intermediate tube to be positioned on a top end of the step in a registered manner and a top circumferential surface of the rotary base to which the intermediate tube structure is assembled forms, at a location overlapping the circumferential step of the plastic sleeve of the intermediate tube structure, equally-divided circumferentially distributed elastic flange plates that are slightly raised to allow the bottom ring of the internally arranged plastic sleeve of the intermediate assembly to directly position on the flange plates to provide an assistance of elastic pushing and positioning in the assembling structure of the intermediate tube so that the plastic sleeve is biased to have a sidewall of each of the spiral guide slots in tight engagement with a corresponding peg of the lipstick holder for eliminating a play therebetween, wherein the circumferentially distributed elastic flange plates collectively define a circumference that has an outside diameter substantially corresponding to the outside diameter of the rotary base and the metal intermediate tube is prevented from directly contacting the rotary base and the flange plates by the circumferential step of the plastic sleeve.

2. The improved assembling structure of intermediate tube of lipstick e according to claim 1, wherein the flange plates have bottoms that form hollow slots to provide the flange plates with elastic assembling for depression.

3. The improved assembling structure of intermediate tube of lipstick according to claim 1, wherein the flange plates are arranged in a circumferentially distributed, equally divided, and symmetric manner.

4. The improved assembling structure of intermediate tube of lipstick according to claim 1, wherein when the sleeve is assembled, a top end of the sleeve is in engagement with and retained by an undersurface of a sloped end of the inner tube.

* * * * *